US010339949B1

(12) United States Patent
Dusan

(10) Patent No.: US 10,339,949 B1
(45) Date of Patent: Jul. 2, 2019

(54) MULTI-CHANNEL SPEECH ENHANCEMENT

(71) Applicant: Apple Inc., Cupertino, CA (US)

(72) Inventor: Sorin V. Dusan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/847,786

(22) Filed: Dec. 19, 2017

(51) Int. Cl.

| | |
|---|---|
| ***G10L 21/02*** | (2013.01) |
| ***G10L 25/84*** | (2013.01) |
| ***H04R 3/00*** | (2006.01) |
| ***G10L 21/0364*** | (2013.01) |
| ***H04R 1/40*** | (2006.01) |
| ***G10L 21/0232*** | (2013.01) |

(52) U.S. Cl.
CPC ..... *G10L 21/0205* (2013.01); *G10L 21/0232* (2013.01); *G10L 21/0364* (2013.01); *G10L 25/84* (2013.01); *H04R 1/406* (2013.01); *H04R 3/005* (2013.01)

(58) Field of Classification Search
CPC ..... G10L 21/0205; G10L 21/0232; G10L 21/0364; G10L 25/84; H04R 1/406; H04R 3/005
See application file for complete search history.

(56) References Cited

U.S. PATENT DOCUMENTS

| | | | | |
|---|---|---|---|---|
| 9,305,567 | B2 | 4/2016 | Visser et al. | |
| 9,502,048 | B2 | 11/2016 | Every et al. | |
| 2009/0238377 | A1* | 9/2009 | Ramakrishnan | G10L 21/028 381/92 |
| 2010/0323652 | A1 | 12/2010 | Visser et al. | |
| 2011/0038489 | A1 | 2/2011 | Visser et al. | |
| 2012/0182429 | A1 | 7/2012 | Forutanpour et al. | |
| 2015/0245129 | A1* | 8/2015 | Dusan | H04R 1/1083 381/71.6 |
| 2016/0155434 | A1 | 6/2016 | Burnett et al. | |

(Continued)

OTHER PUBLICATIONS

Y. Ephraim and D. Malah, "Speech enhancement using optimal non-linear spectral amplitude estimation," in Proc. IEEE In?. Conf. Acoust. Speech Signal Processing (Boston), 1983, pp. 1118-1212.

(Continued)

*Primary Examiner* — Stella L. Woo
(74) *Attorney, Agent, or Firm* — Ganz Pollard, LLC

(57) ABSTRACT

Speech enhancers suppress impairments in an acoustic signal. An audio appliance has a first microphone and a second microphone. The first microphone provides a first signal, and the second microphone provides a second signal. A voice-activity detector can determine a presence of user speech responsive to a combination of voice-activity cues, including a first level difference between the first signal and the second signal within a first frequency band, and a second level difference between the first signal and the second signal within a second frequency band. A noise suppressor suppresses impairments originating from a direction of, e.g., up to about 75-degrees from an axis extending from the second microphone to the first microphone. An output device can output a noise-suppressed output-signal corresponding to a determined presence or absence of speech by the voice-activity detector. The impairments can be suppressed by, e.g., between about 3 dB and about 20 dB.

19 Claims, 10 Drawing Sheets

(56) References Cited

U.S. PATENT DOCUMENTS

2017/0263267 A1* 9/2017 Dusan ..... G10L 25/78
2018/0350394 A1* 12/2018 Saffran ..... H04R 1/1083

OTHER PUBLICATIONS

Y. Ephraim and D. Malah, "Speech enhancement using a minimum mean-square error log-spectral amplitude estimator," IEEE Trans. Acoustics, Speech and Signal Processing, 33(2): 443-455, Apr. 1985.

J. S. Lim and A. V. Oppenheim, "Enhancement and bandwidth compression of noisy speech," Proc. IEEE, vol. 67, No. 12, pp. 1586-1604, Dec. 1979.

R. J. McAulay and M. L. Malpass, "Speech enhancement using a soft- decision noise suppression filter," IEEE Trans. Acoust. Speech Signal Processing, vol. ASSP-28, No. 2, pp. 137-145, Apr. 1980.

* cited by examiner

MULTI-CHANNEL SPEECH ENHANCEMENT

FIELD

This application and the subject matter disclosed herein (collectively referred to as the "disclosure") generally concern speech enhancement for audio appliances. More particularly, but not exclusively, the disclosure pertains to systems, methods, and components to remove unwanted audio from an observed audio signal, and more particularly but not exclusively, to voice-activity detectors and/or noise suppressors to enhance a speech portion of an impaired audio signal. By way of illustration, some disclosed principles are described in relation to a headset (e.g., a headphone or an earphone).

BACKGROUND INFORMATION

Some commercially available audio appliances, including headphones and earphones, incorporate one or more microphone transducers suitable for converting incident acoustic energy (e.g., contained in sound waves) to one or more corresponding electrical signals. Depending on an environment in which such an audio appliance is used, the incident acoustic energy may include an impairment (or distractor) to a desired audio signal. For example, in a café setting, observations of a user's speech (e.g., the desired signal) can be impaired by clattering dishes, ambient music, others' speech, etc. Such impairments can range from being barely perceptible in an observed signal to rendering a desired audio signal unintelligible in the observed signal.

SUMMARY

Noise cancellers and noise suppressors have been used to enhance speech in a variety of audio appliances, for example, mobile communication systems, speech recognition systems, hearing aids, and headsets. Nonetheless, some speech enhancers permit certain impairment signals to pass unattenuated through a noise canceller and/or noise suppressor. Presently disclosed speech enhancers address those and/or other unsolved needs in the art.

In some respects, concepts disclosed herein generally concern speech enhancement for audio appliances and are described by way of reference to systems, methods, and components for removing or suppressing unwanted audio impairments from an observed audio signal. As but one example, some disclosed principles pertain to voice-activity detectors and/or noise suppressors to enhance a speech portion of an impaired audio signal.

An exemplary audio appliance includes a first microphone transducer to provide a first acoustic signal, and a second microphone transducer to provide a second acoustic signal. A voice-activity detector can determine a presence or an absence of speech responsive to a combination of voice-activity cues. Such voice-activity cues can include a first level difference between the first acoustic signal and the second acoustic signal within a first frequency band. The voice-activity cues can also include a second level difference between the first acoustic signal and the second acoustic signal within a second frequency band. An output device can output a noise-suppressed output-signal corresponding to a determined presence or a determined absence of speech by the voice-activity detector.

The combination of voice-activity cues can also include a comparison of the first level difference to a first threshold and a comparison of the second level difference to a second threshold. The voice-activity detector can determine a presence of speech responsive to the first level difference exceeding the first threshold and the second level difference exceeding the second threshold.

In some instances, the comparison of the first level difference to the first threshold and the comparison of the second level difference to the second threshold can be combined to yield a first voice-activity cue.

The combination of voice-activity cues can also include a second voice-activity cue, such as, for example, a comparison of the second level difference to a third threshold and a comparison of the first level difference to a fourth threshold. In those instances, the voice-activity detector can determine a presence of speech responsive to the second level difference exceeding the third threshold and the first level difference exceeding the fourth threshold.

In some instances, the voice-activity cues also include a level difference between a first beam-formed combination of the first acoustic signal with the second acoustic signal and a second beam-formed combination of the first acoustic signal with the second acoustic signal. For example, the voice-activity detector can determine a presence of speech responsive to level difference between the first beam-formed combination and the second beam-formed combination exceeding a corresponding threshold level difference.

Some audio appliances also include an accelerometer, and a voice-activity cue can also include a comparison of an output from the accelerometer within a selected frequency band to a corresponding threshold.

In some audio appliances, the noise-suppressed output-signal can be synthesized from a plurality of gain-adjusted frequency bins of the first acoustic signal, the second acoustic signal, or a selected beam-formed combination of the first acoustic signal with the second acoustic signal. And, each gain-adjusted bin can correspond to a respective gain derived from an estimate of noise-power in the respective bin of an observed signal. Further, the estimate of noise-power in the respective bin can correspond to the determined presence or absence of speech by the voice-activity detector.

Some audio appliances include a first microphone transducer, a second microphone transducer, an output device, a processor, and a memory. The memory can contain instructions that, when executed by the processor, cause the audio appliance to receive a first audio signal from the first microphone transducer and to receive a second audio signal from the second microphone transducer. The executed instructions can also cause the audio appliance to determine a presence or an absence of speech responsive to a combination of voice-activity cues. The voice-activity cues can include one or more of the cues described herein. The executed instructions can also cause the audio appliance to output a noise-suppressed output-signal corresponding to the determined presence or absence of speech.

For example, the voice-activity cues can include a comparison of the first level difference to a first threshold and a comparison of the second level difference to a second threshold. The instructions can also cause the appliance to determine a presence of speech responsive to the first level difference exceeding the first threshold and the second level difference exceeding the second threshold.

The combination of voice-activity cues can also include a level of a first beam-formed combination of the first acoustic signal and the second acoustic signal within a fourth frequency band, a level of a second beam-formed combination of the first acoustic signal and the second acoustic signal within the fourth frequency band, a level difference between the first beam-formed combination and the second beam-formed combination, or a combination thereof. The audio appliance can also include an accelerometer, and the combination of voice-activity cues can further include an output from the accelerometer within a third frequency band.

In some audio appliances, a first microphone transducer is spaced apart from a second microphone transducer to define a longitudinal axis. Such audio appliances can also include an output device, a processor, and a memory. The memory can contain instructions that, when executed by the processor, cause the audio appliance to determine a presence of voice activity in an observed acoustic signal. Responsive thereto, the executed instructions can cause the audio appliance to suppress impairments originating from a direction of up to about 75-degrees or more from the longitudinal axis, e.g., in a direction from the second microphone to the first microphone. The instructions can also cause the audio appliance to synthesize and to output a noise-suppressed output signal corresponding to the observed acoustic signal and the suppressed impairments.

In some instances, a level of impairments originating from a direction of up to about 75-degrees or more from the longitudinal axis can be suppressed by between about 3 dB and about 20 dB compared to a level of the impairments in the observed acoustic signal.

Some audio appliance also determine the presence of voice activity in the observed acoustic signal responsive to a combination of voice-activity cues. The combination of voice-activity cues can include a first comparison of a first voice-activity statistic to a corresponding first threshold value and a comparison of a second voice-activity statistic to a corresponding second threshold value. Such audio appliances can also include an accelerometer and/or a beam former. Such a beam former can generate one or more beam-formed combinations of an output from the first microphone transducer with an output from the second microphone transducer.

The first voice-activity statistic can include a measure of an acoustic signal from the first microphone, a measure of an acoustic signal from the second microphone, a measure of an output from the accelerometer, and/or a measure of an output from the beam former.

Also disclosed are associated methods, as well as tangible, non-transitory computer-readable media including computer executable instructions that, when executed, cause a computing environment to implement one or more methods disclosed herein. Digital signal processors embodied in software, firmware, or hardware and being suitable for implementing such instructions also are disclosed.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION

Figure 1:
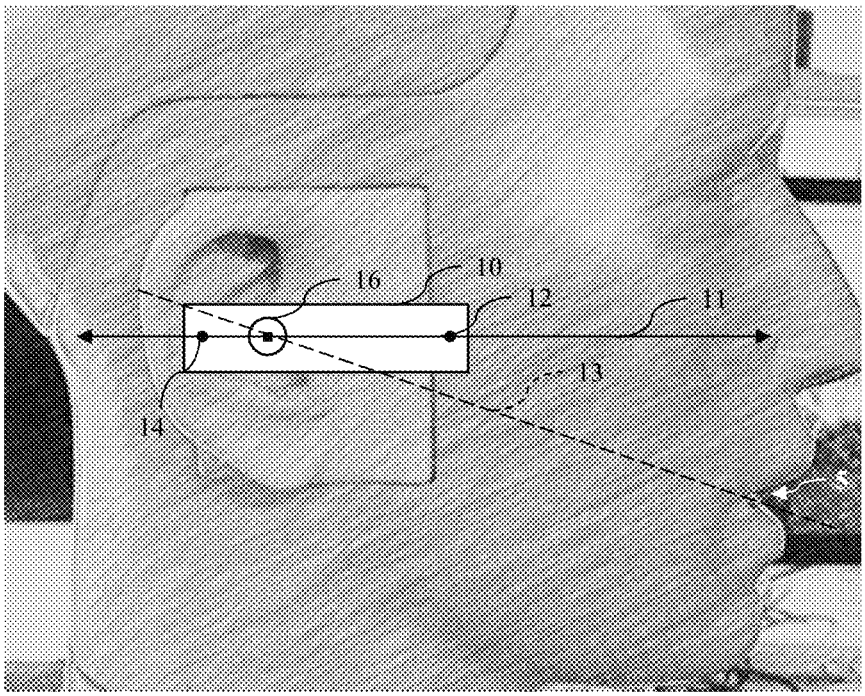
FIG. 1 schematically illustrates a headset in the form of an earphone being worn by a user.

The following describes various principles related to enhancing speech. For example, certain aspects of disclosed principles pertain to systems, methods, and components to remove unwanted audio from an observed audio signal. That said, descriptions herein of specific apparatus configurations and combinations of method acts are but particular examples of contemplated systems, methods, and components chosen as being convenient illustrative examples of disclosed principles. One or more of the disclosed principles can be incorporated in various other systems, methods, and components to achieve any of a variety of corresponding, desired characteristics.

Thus, a person of ordinary skill in the art, following a review of this disclosure, will appreciate that systems, methods, and components having attributes that are different from those specific examples discussed herein can embody one or more presently disclosed principles, and can be used in applications not described herein in detail. Such alternative embodiments also fall within the scope of this disclosure.

I. Overview

Some speech enhancement techniques attenuate ambient noises by computing gains from an estimated noise (level or power) across frequencies based on a spectral separation between a primary signal and a reference signal. For example, the primary signal can be generated by a microphone positioned proximally relative to a user's mouth and the reference signal can be generated by a microphone positioned distally relative to a user's mouth. A frequency-by-frequency difference in level (or power) between the primary signal and the reference signal can be used to compute a gain to apply to the primary signal, for example, in a noise-suppression technique.

Some mobile phones use a similar technique, as a distance between a user's mouth and each of, e.g., two microphones of a mobile phone, can differ substantially. For example, one microphone can be positioned much closer to a user's mouth than the other, allowing speech to dominate observed audio in one microphone transducer and background noise to dominate observed audio in another microphone transducer. In some instances, spectral separation between signals from the two microphones can be between about 10 dB and about 15 dB.

Those techniques, however, cannot typically be applied directly to signals generated by relatively closely spaced microphones, especially when a surrounding environment induces localized spectral variations in observed signals. For example, audio observed by microphones on a headset (e.g., a headphone or earphone) can be influenced in a frequency-dependent manner by, e.g., a user's head, torso, and ear, as well as by distance from and bearing to each audio source relative to the headset. Stated differently, a user's anatomy, as well as an orientation of the microphones relative to each other and the user's head, torso, and ear, can influence observed audio signals differently across frequencies. Consequently, spectral separation between microphone signals can vary across frequency bands and can even reverse relative magnitude in some frequency bands.

Disclosed concepts exploit such spectral variations to discern periods of speech, and to apply appropriate measures of gain to enhance observed speech.

FIG. 1 shows a user wearing a headset in the style of an earphone 10. The earphone 10 has a first microphone transducer 12 and a second microphone transducer 14 spaced apart from each other along a longitudinal axis 11 of the earphone. Also shown in an axis 13 between the earphone 10 and the user's mouth 5 from which speech 1 emanates.

The earphone 10 in FIG. 1 optionally also has an accelerometer 16 suitable for sensing vibrations corresponding to a user's speech. The accelerometer can emit an electrical signal corresponding to an acceleration of the headset or a region thereof, and each microphone transducer can emit an electrical signal (referred to herein as an "acoustic signal") corresponding to incident audio (e.g., sound waves). In some headsets, the accelerometer can vibrate in correspondence to vibrations transferred to the headset, as by contact with a user's skin. For example, during speech, a user's skull and other anatomy can vibrate, and the vibrations can be transferred to the headset, as through contact between the headset and a user's ear canal. The resulting vibrations can be detected by an accelerometer, which can output an electrical signal in correspondence to the vibrations.

As well, some headsets can have a beam former (not shown) to generate a so-called voice beam 18 and a so-called noise beam 17 from the acoustic signals emitted by the microphones. The voice-beam 18 can generally be directed along a longitudinal axis 11 of the headset in a direction from the second microphone 14 to the first microphone 12. The noise beam 17 can generally be directed opposite the voice beam, e.g., directed along the longitudinal axis 11 in a direction from the first microphone 12 to the second microphone 14.

Figure 2:
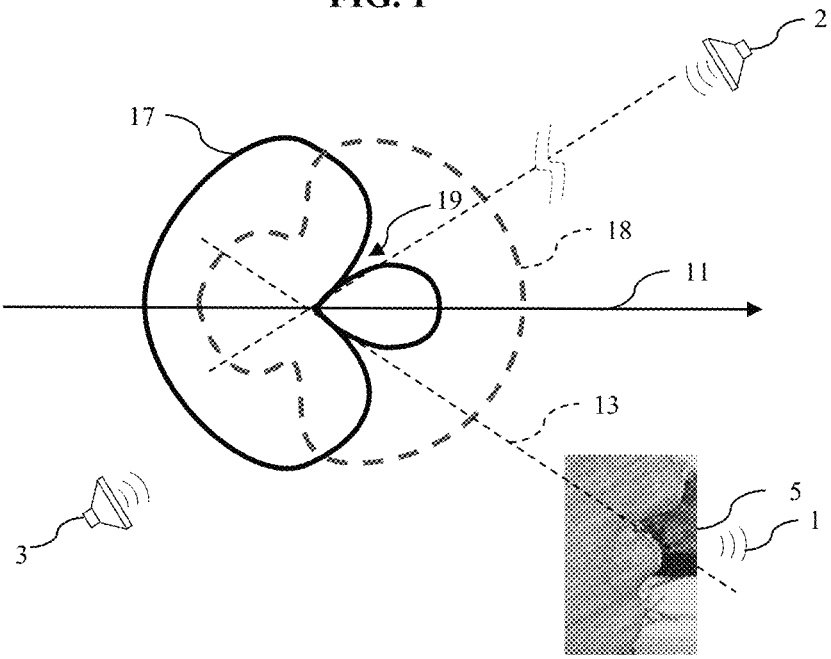
FIG. 2 schematically illustrates a voice-beam and a noise-beam formed by the earphone shown in FIG. 1 relative to the user's mouth and two sources of impairment signals.

A first beam former (not shown) can generate a rearward-facing beam 17 (also referred to herein as a "noise beam") generally directed away from the user's mouth 5, and a second beam former can generate a forward-facing beam 18 (also referred to herein as a "voice-beam") generally directed toward the user's mouth 5. FIG. 2 shows a representative spatial-directivity pattern of the noise-beam 17 superimposed on a representative spatial-directivity pattern of the voice-beam 18, both in polar coordinates. A person of ordinary skill in the art will appreciate that, although only two microphones 12, 14 are depicted in FIG. 1 for simplicity, the earphone 10 can incorporate a larger plurality of microphones for generating the noise-beam 17, the voice-beam 18, and one or more other beam forms or spatial directivity patterns.

Figure 3:
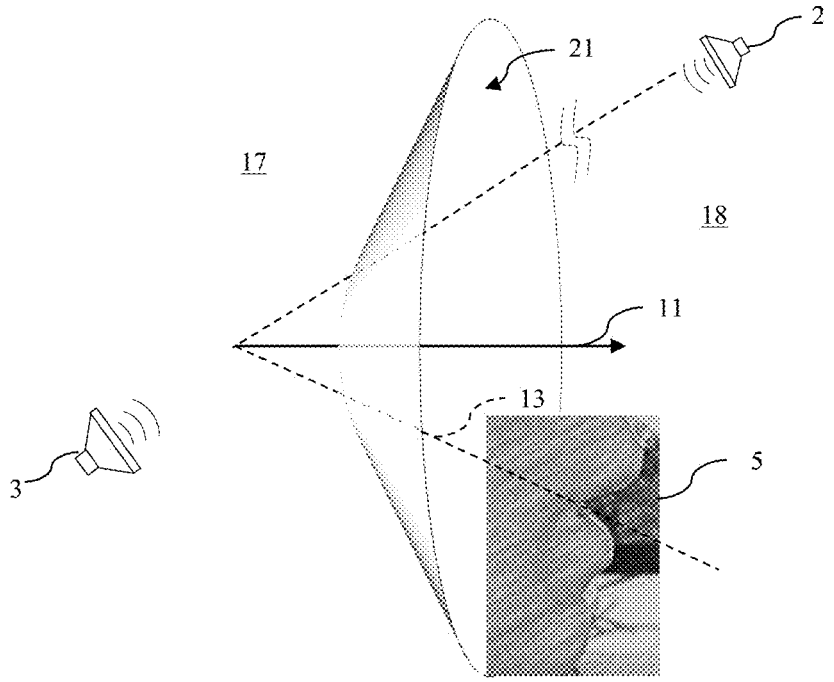
FIG. 3 shows representative regions within which impairments to observed audio can be removed, cancelled, or suppressed.
Figure 4:
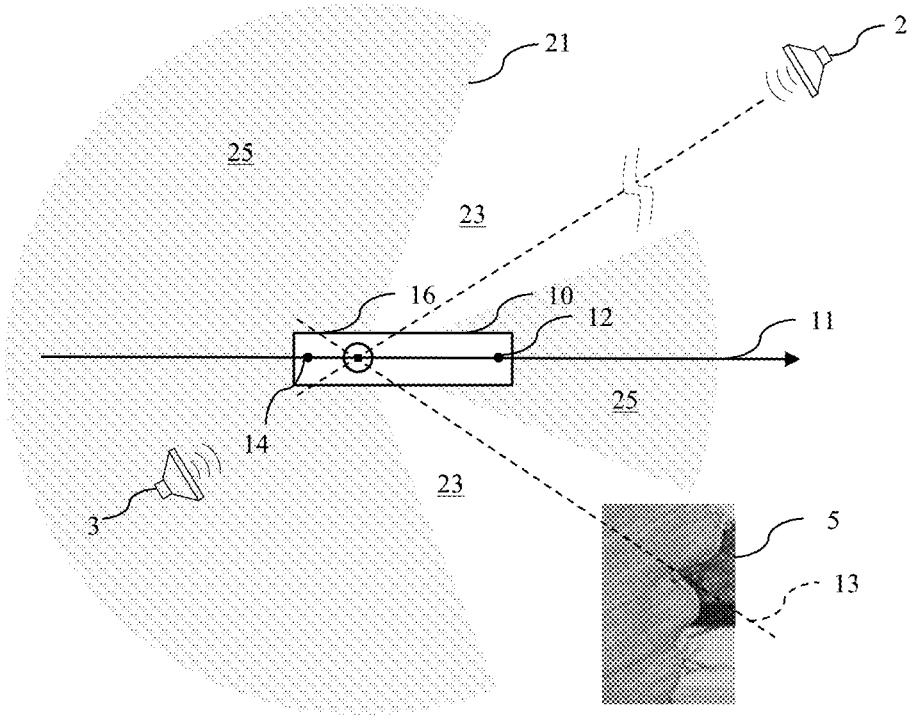
FIG. 4 shows representative regions within which impairments to observed audio can be removed, cancelled, or suppressed by the audio appliance.

The noise beam 17 can be adaptive to generate a null 19 in the general direction of the user's mouth 5 (FIGS. 2 through 4). Such a null 19 can generate a spectral separation 20 (FIG. 5) between the voice beam 18 and the noise beam 17. With a spectral separation 20 as shown in FIG. 5, a user's speech 1 can pass through a speech enhancer unattenuated, while impairments 3 from certain other directions can be attenuated.

However, the noise-beam null 19 in the general direction of the user's mouth 5 applies to all acoustic signals 1, 2 originating from the direction of the nulls, e.g., forward of a selected spherical sector 21 as in FIG. 3, or within the unshaded regions in FIG. 4. In FIG. 3, the spherical sector 21 corresponding to the noise-beam null 19 extends up to about 75-degrees, such as, for example, between about 0-degrees and about 85-degrees, from the longitudinal axis 11 extending from the second microphone transducer 14 to the first microphone transducer 12. In FIG. 4, the spherical sector (e.g., unshaded regions 23) corresponding to the noise-beam null 19 extends between about 30-degrees and about 75-degrees from the longitudinal axis 11.

Figure 5:
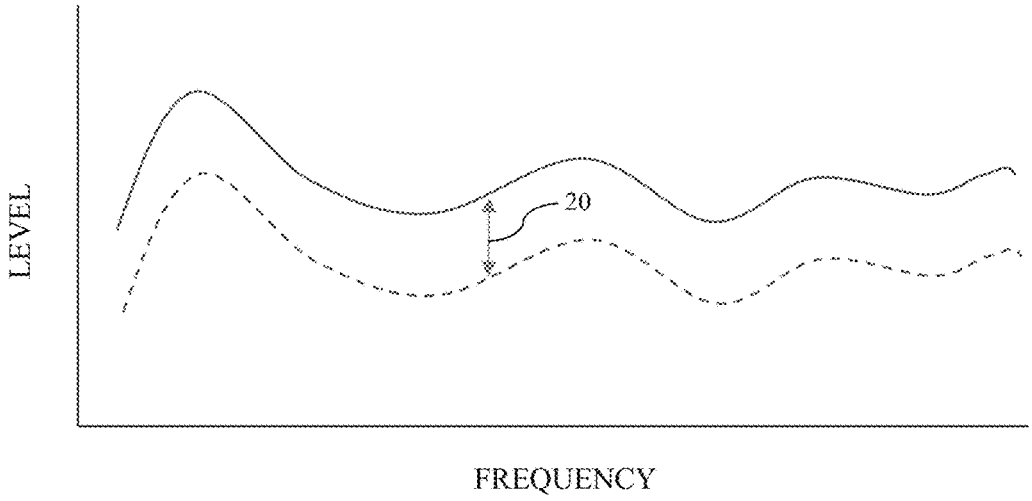
FIG. 5 shows a representative plot of level difference for an audio appliance.

Thus, noises and distractors (generally referred to as impairments 2) coming from a direction of the voice beam 18 (FIG. 2) can pass unattenuated through a speech enhancer based solely on the spectral separation 20 shown in FIG. 5. Consequently, a user's speech 1 or other intended audio signal can be impaired by noise 2 or other undesired audio signals originating in a direction of the voice beam 18. Accordingly, a need exists for a speech enhancer to enhance observations of a user's speech 1 despite noise 2 coming from a similar direction as the speech.

The principles disclosed herein overcome many problems in the prior art and address one or more of the aforementioned or other needs. For example, in some respects, a disclosed speech enhancer can allow a user's speech to pass unattenuated (or at least imperceptibly attenuated) while noises and distractors or other impairments 2 originating from the same general direction as a user's mouth 5 can be attenuated, spatially and/or temporally. Some disclosed speech enhancers incorporate information from a plurality of channels, such as, for example, one or more microphones, one or more accelerometers, and/or one or more beam-forming, microphone arrays.

Presently disclosed speech enhancers derive from and exploit acoustic phenomena of wave propagation, reflection, refraction, diffraction, summation, and subtraction at and around a typical user's head, shoulder, and pinna (e.g., for a headset user). Those phenomena result in different spectral effects at each position on or in a donned headset.

Consequently, the spaced-apart microphones 12, 14 shown in FIG. 1 observe a given acoustic signal emitted from a same source differently. For example, in FIG. 1, one microphone 12 is positioned closer to a user's mouth 5 than the other microphone 14. As a user's speech 1 (vocalized and non-vocalized) propagates, reflects, refracts, diffracts, sums and subtracts by virtue of the user's anatomy, the first microphone 12 receives a different audio signal than the second microphone 14. Those acoustic effects also cause differences in spectral energy received by the first microphone 12 and second microphone 14 when sound comes from a distal source (e.g., away from the user's mouth 5, as in front of the user or alongside or behind the user). Further, the acoustic effects cause different relative responses between the first and the second microphones 12, 14 depending on whether sound originates from a user's mouth 5 or from a source farther away than the user's mouth.

Figure 6:
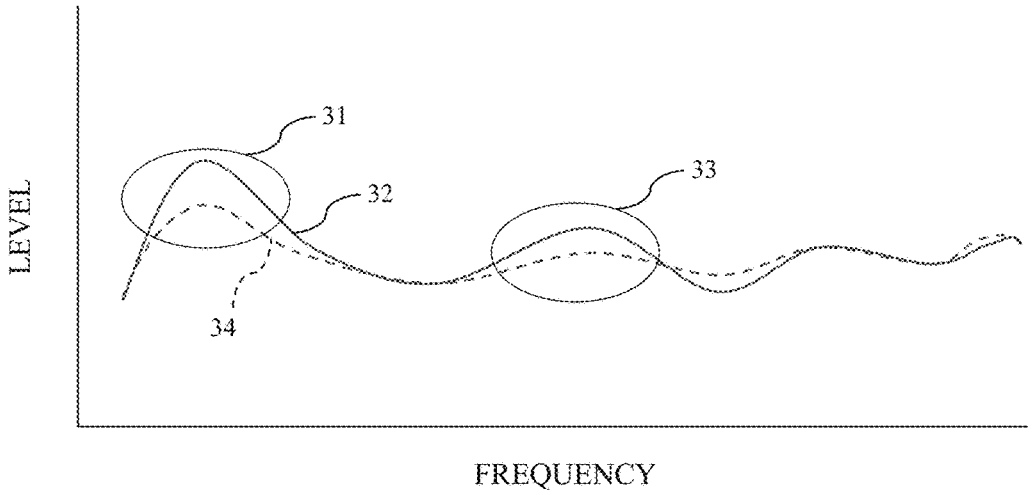
FIG. 6 shows a representative plot of level difference for an audio appliance of the type shown in FIG. 1.

However, as shown in FIG. 6, when excited by user speech, the difference 31, 33 in magnitude or power observed by the two microphones 12, 14 is significantly smaller across several frequency bands, or even reversed across some frequency bands, compared to the spectral separation 20 between the voice beam and the noise beam in FIG. 5. And, in FIG. 6, the magnitude differences 31, 33 between signals are close to zero across most frequency bands.

That said, some frequency bands exhibit positive, albeit small, magnitude differences 31, 33. For example, a working embodiment exhibited a variation in inter-microphone level difference of between about 1 dB and about 2 dB, such as, for example, between about 0.9 dB and about 2.2 dB, in a frequency band between about 200 Hz and about 900 Hz, such as, for example, between about 220 Hz and about 810 Hz. The same working embodiment exhibited a variation in inter-microphone level difference of between about 2 dB and about 5 dB, such as, for example, between about 1.8 dB and about 5.5 dB, in a frequency band between about 4 kHz and about 5 kHz, such as, for example, between about 3.6 kHz and about 5.5 kHz. However, those comparatively small spectral differences across narrow frequency bands cannot be exploited using known techniques for 2-channel noise suppression. Rather, those known techniques can require significant and consistent inter-microphone level differences across a broad spectrum of frequencies, as with the spectral separation 20 shown in FIG. 5.

Additionally, the acoustic response at each of the microphones 12, 14 in a working embodiment of a headset 10 (FIG. 1) evoke consistent patterns according to a close audio source (e.g., speech 1 from a user's mouth 5). Such acoustic effects or responses are generally referred to herein as "cues." FIG. 6 shows a representative example of each microphone's acoustic response to, e.g., a user's speech. The acoustic response at each of the microphones 12, 14 in a working embodiment of a headset 10 (FIG. 1) evoke similar patterns in the two microphones for a distally positioned impairment source (e.g., source 2 of FIG. 2).

Because acoustic responses at each of the microphones 12, 14 are generally consistent within each class of audio source (e.g., vocalized speech, non-vocalized speech, noise from afar), an acoustic response 32, 34 for each microphone 12, 14 (and a resulting inter-microphone difference 31, 33, or spectral separation) can be characterized for each class of audio source-of-interest. After characterization, a class (e.g., speech, ambient music, café noise) to which an unknown audio source belongs can be inferred or derived from observing acoustic responses 32, 34 to the unknown audio source and comparing the observed acoustic responses to the characteristics of each class of audio source-of-interest. Accordingly, acoustic effects of wave propagation, reflection, refraction, diffraction, summation, and subtraction can be exploited to identify audio sources and/or to select an appropriate approach for suppressing unwanted noise 2 from an observed signal.

When speech 1 (voiced or unvoiced) is identified as an audio source, the gain in each frequency bin can be computed from impairment content, e.g., based on a stationary noise estimate. Alternatively, when an absence of speech is inferred (e.g., from the observed acoustic response and comparison to characterized acoustic responses), the gain in each frequency bin can be computed based on, e.g., the energy content in that bin of the observed signal.

As described more fully below, a headset 10 can include an accelerometer 16 in addition to the first microphone 12 and the second microphone 14. Further, a headset can include a larger plurality of microphones, such as three, four, five, or more, microphone transducers. And, the headset can include a beam former to generate a noise beam, a voice beam, or other beam formers, from a microphone array, e.g., the plurality of microphones.

The signal from each microphone, accelerometer, and beam former can represent an independent channel containing an observation of an audio source 1, 2, 3 (FIG. 2). As above, each independent channel's signal can be characterized according to each source in a plurality of audio sources. In turn, the characterizations can be used to infer a class of an unknown audio source by comparing prior characterizations to each channel's response to the unknown audio source.

For example, a plurality of cues indicative of, e.g., voice activity, can be derived from the characterizations of each channel's response to, e.g., user speech. Subsequently, such cues can be derived, computed or otherwise evaluated based on observations (FIG. 6) of an unknown audio source. Each cue, in turn, can be combined with one or more other cues to provide a respective indicium of the unknown audio source's classification. Subsequent to classification of the unknown source or signal content, a corresponding degree of noise suppression or other processing can be applied to the observed signals according to the classification. The processed signal can be output from the audio appliance by an output device.

Further details of disclosed principles are set forth below. Section II describes a multi-channel speech-enhancement framework and computation of examples of voice-activity cues. Section III describes principles pertaining to speech enhancers incorporating four cues indicative of a presence or an absence of user speech. Section IV describes principles pertaining to speech enhancers incorporating three cues indicative of a presence or an absence of user speech, and Sections V and VI describe principles pertaining to a speech enhancers incorporating two cues indicative of a presence or an absence of user speech. Section VII describes principles related to computing environments suitable for implementing disclosed speech enhancement technologies.

Other, related principles also are disclosed. For example, the following also describes machine-readable media containing instructions that, when executed, cause a processor of, e.g., a computing environment, to perform one or more disclosed methods, processes or techniques. Such instructions can be embedded in software, firmware, or hardware. In addition, disclosed methods and techniques can be carried out in a variety of forms of processor or controller, as in software, firmware, or hardware.

II. Multi-Channel Speech-Enhancement Framework and Voice-Activity Cues

Figure 7:
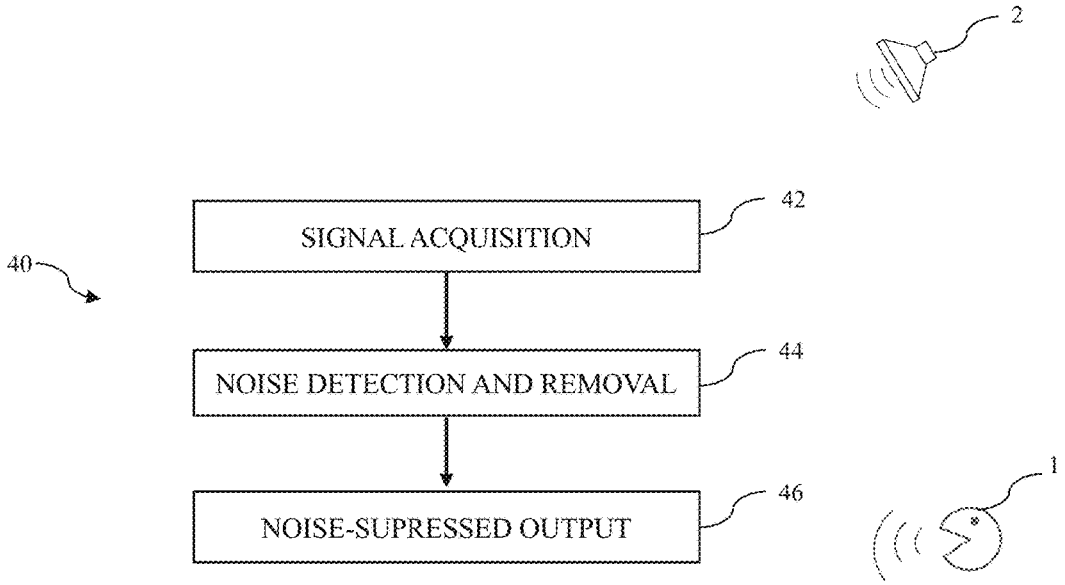
FIG. 7 schematically illustrates a technique for removing, cancelling, or suppressing an impairment to an observed audio signal.

FIG. 7 generally illustrates an approach to remove noise 2 to enhance speech in an observed audio signal. The signal is acquired at block 42. Noise 2 is detected and removed in block 44, and a noise-suppressed signal is output at block 46. The resulting noise-suppressed output can be output from an audio appliance by an output device. In some audio appliances, a selected approach for removing the impairment can correspond to a presence or an absence of speech, as well as a magnitude of level difference between selected audio channels.

Figure 8:
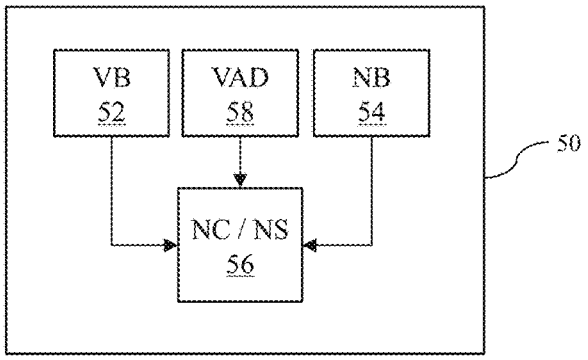
FIG. 8 schematically illustrates an example architecture for detecting, removing, cancelling, or suppressing an impairment to an observed audio signal.

As but one example, as schematically illustrated in FIG. 8, a noise-cancellation and/or noise-suppression module 50 can receive a voice beam stream 52 and a noise beam stream 54. If a level separation between the voice beam and the noise beam is sufficiently large, the noise-cancellation module can use a previously known approach to remove an impairment portion from the voice-beam 52. Alternatively, if the level separation is comparatively small, or if it exists over selected frequency bands as described herein, the module 56 can provide a spectral gain to one or more channels carrying speech to suppress impairments thereto, as described herein. Alternatively or additionally, the module 56 can receive an output from a voice-activity detector 58 to inform selection of an appropriate noise-cancellation and/or noise-suppression technique. Accordingly, disclosed speech enhancers can be considered as being adaptive in nature.

Figure 9:
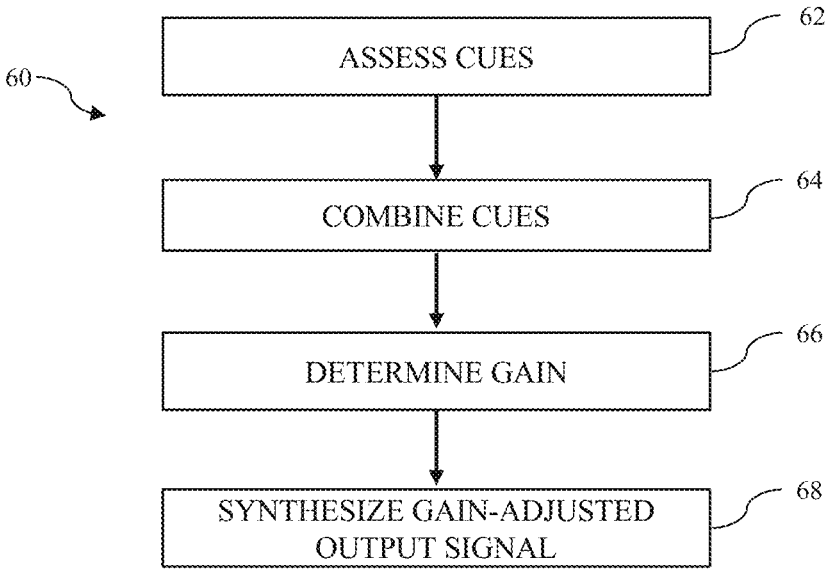
FIG. 9 schematically illustrates a technique for detecting, removing, cancelling, and/or suppressing an impairment to an observed audio signal.

Referring now to FIG. 9, an example of a voice-activity-detection technique 60 is described. Some voice-activity detectors can determine a presence or an absence of user's speech responsive to a combination of voice-activity cues. In turn, an observed acoustic signal can undergo equalization or another spectral-gain adjustment corresponding, at least in part, to the determination by the voice-activity detector.

Each respective signal from the first microphone 12, the second microphone 14, the accelerometer 16, the voice-beam 18 and the noise-beam 17 can be used to define a voice-activity cue. Some voice-activity cues are derived from a comparison of a signal statistic to a corresponding threshold value, as in block 62. For example, when a given statistic, or characteristic, of a segment of a signal exceeds a threshold value, a likelihood that segment contains speech may be large.

Figure 10:
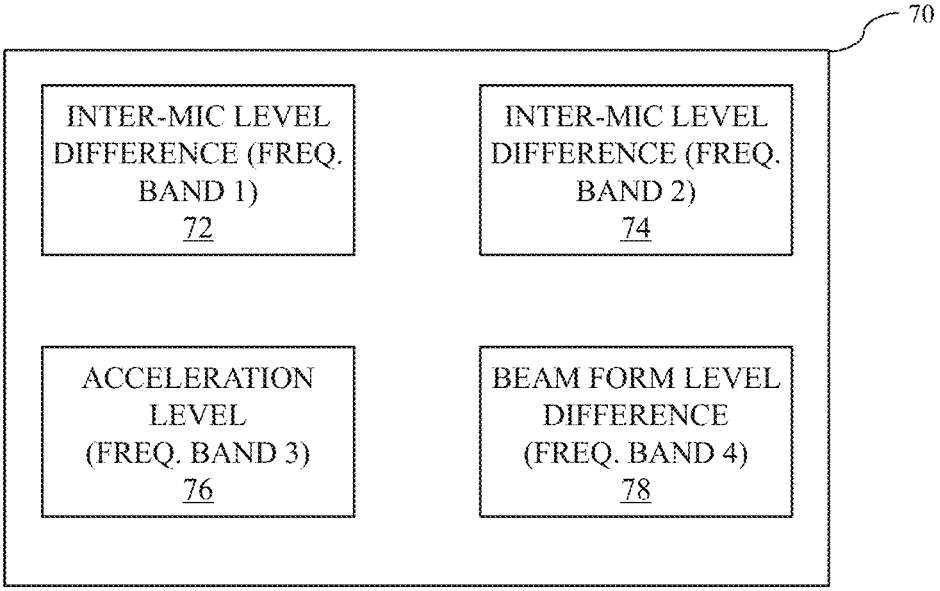
FIG. 10 shows an architecture for assessing a plurality of cues indicative of a presence or an absence of speech in a segment of an audio signal.

FIG. 10 illustrates a module 70 for computing several statistics suitable for indicating a likelihood of speech as part of the assessment in block 62. The statistics can include a level difference 72, 74 between selected microphone channels (e.g., spectral separation), a level (or power) of acceleration 76 observed in a headset, and a level difference between beam formers (e.g., spectral separation) 78. Each of the foregoing listed voice-activity statistics can be assessed in block 62 over one or more selected frequency bands, and the frequency bands can differ among the various statistics. Voice-activity cues can be assessed by comparing each respective statistic to a corresponding threshold value above which (or in some instances below which) an occurrence of voiced- or unvoiced-speech is likely.

In turn, a voice-activity detector 58 (FIG. 8) can combine each respective voice-activity cue with one or more other voice-activity cues at block 64 (FIG. 9) to determine whether user speech is present in the respective signal segment. At block 66, responsive to the voice-activity determination, a spectral gain in each frequency bin can be computed and applied to an impaired signal to suppress impairment portions of the signal and/or to emphasize desired portions of the signal (e.g., user speech). At block 68, a gain-adjusted output signal can be synthesized from, e.g., several gain-adjusted frequency bins.

Figure 11:
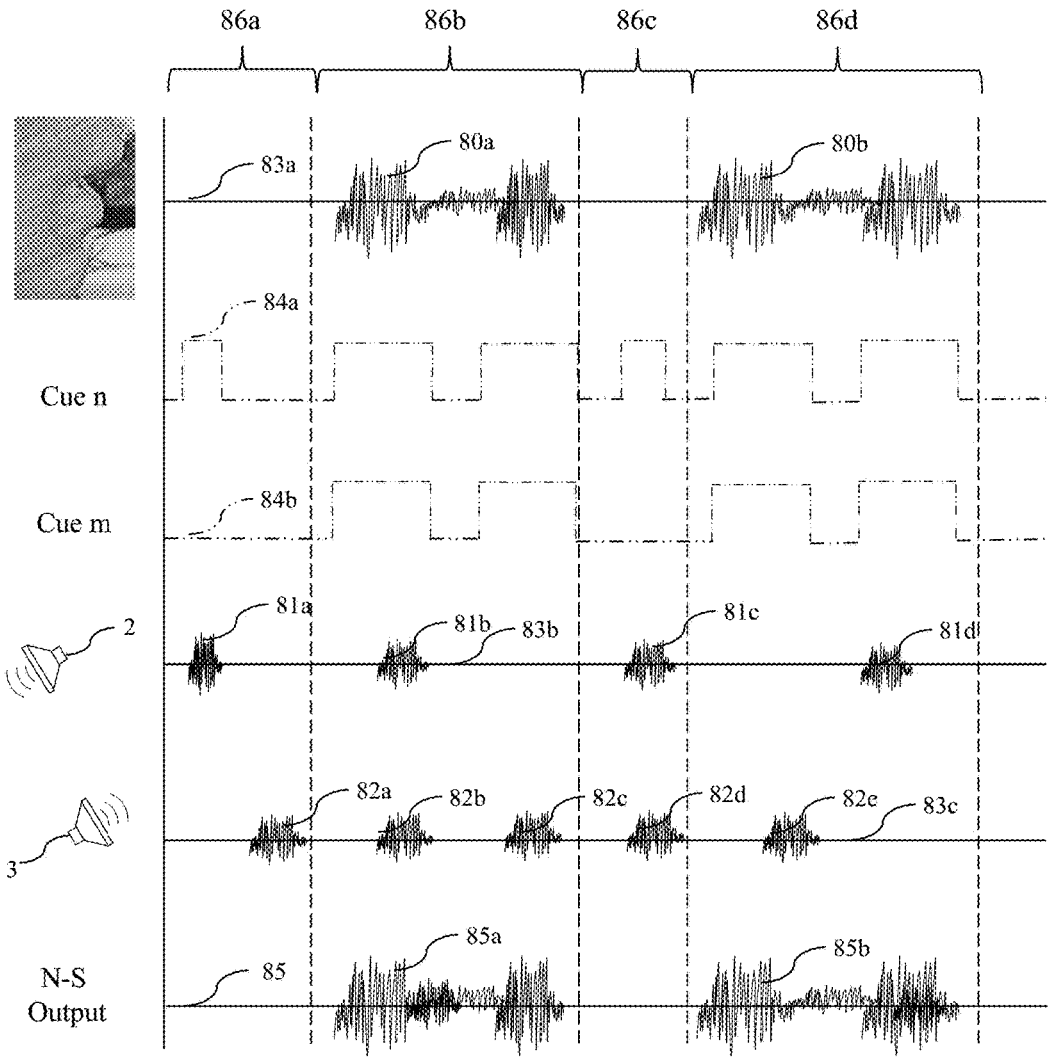
FIG. 11 schematically shows a temporal representation of user speech, impairments to the speech, exemplary cues indicative of a presence or an absence of user speech, and a noise-suppressed output signal.

FIG. 11 schematically illustrates several temporal aspects of disclosed speech enhancement techniques. For convenience of illustration, speech portions 80*a*, 80*b* and impairment portions 81*a*-81*d*, 82*a*-82*e* of an observed acoustic signal are shown on separate channels 83*a*, 83*b*, and 83*c* in FIG. 11. For example, user speech content 80*a*, 80*b* is shown on channel 83*a*, an impairment signal coming from a direction generally within a noise-beam null 19 (FIGS. 2 through 4) is shown on channel 83*b*, and an impairment signal coming from a direction generally within the noise beam 17 (FIGS. 2 through 4) is shown on channel 83*c*. Nonetheless, it is understood that the impairments and the user speech content are actually combined on each channel of observed audio.

Further, in FIG. 11, a first voice-activity cue n is shown on channel 84*a*, and a second voice-activity cue m is shown on channel 84*b*. Each voice-activity cue switches between 0 and 1 corresponding to whether the underlying statistic indicates a presence of speech (cue value equals 1) or an absence of speech (cue value equals 0).

By way of illustration, cue n indicates a presence of speech (value equals 1) during each instance of speech 80*a*, 80*b* on channel 83*a*, but it also indicates a presence of speech, in this example, when an impairment signal 81*a* originates from a direction generally within the null of the noise beam (e.g., on channel 83*b*). Cue m, on the other hand, indicates a presence of speech 80*a*, 80*b* only during each instance of speech on channel 83*a*.

A voice-activity detector as described herein can combine the outputs of cue n and cue m using one or more Boolean operators (e.g., an AND or an OR) to arrive at an overall voice-activity decision. In this example, combining the output of cue n and cue m using a Boolean AND yields an accurate determination of a presence or an absence of speech 80*a*, 80*b*.

As described more fully below, a spectral gain can be derived from an estimate of, e.g., stationary noise power arising from each impairment signal during periods of user speech. As well, during periods having an absence of speech (as determined by a voice-activity detector), all energy in the signal can be assumed to be noise. Consequently, the gain can be derived to altogether cancel the acoustic signal during those periods.

The resulting enhanced speech signal 85*a*, 85*b* is shown on channel 85. Note that during time segments 86*a* and 86*b* (e.g., between segments 86*b*, 86*d* containing speech 80*a*, 80*b*), the enhanced speech channel 85 carries no content, despite the presence of impairment content 81*a*, 82*a*, 81*c*, and 82*d* during those times.

By way of further detail, several voice-activity statistics suitable for use in a speech-enhancement framework are described. The statistics can be computed over broad, albeit less-than-full-spectrum, frequency bands, as indicated in FIG. 6. The frequency bands typically are larger than individual frequency bins, and can be selected to correspond to a given configuration of an audio appliance, such as, for example, a headset having a particular configuration.

In general, the statistics can reflect selected measures of sound power, sound-pressure level, and/or other measures of acoustic energy observed by a selected combination of transducers. For example, some statistics reflect inter-microphone differences of acoustic level (or power). Other statistics reflect levels (or power) of vibration (e.g., acceleration) to which an audio appliance may be exposed. Still other statistics reflect level differences between selected beamformers.

Each statistic can be determined or observed over one or more selected frequency bands. Moreover, a value of each statistic, e.g., within a selected frequency band or sub-band, can be compared to a threshold value corresponding to the respective frequency band or sub-band. A value of each statistic compared to the respective threshold can provide an indicium of a likelihood that a particular signal segment contains user speech or other desired content.

For example, the following voice-activity statistics can be computed:

(a) ST1M: average power difference across a first frequency range (e.g., between about 200 Hz and about 900 Hz, for a particular working embodiment) between signals from a first microphone 12 positioned adjacent a proximal end of the headset 10 and from a second microphone 14 positioned adjacent a distal end of the headset.

(b) ST2M: average power difference across a second frequency range (e.g., between about 4 kHz and about 5 kHz) between signals from the first and the second microphones 12, 14.

(c) ST3A: average power across a third frequency range (e.g., between about 250 Hz and about 800 Hz) in a signal from an accelerometer 16 responsive to vibrations transmitted through a user's head and imparted to, e.g., the headset 10.

(d) ST4B: average power difference across a fourth frequency range (e.g., between about 500 Hz and about 2.5 kHz) between signals from two beamformers (e.g., a voice beam 18 and a noise beam 17).

The foregoing set of four statistics, or a selected subset of those statistics, can be computed and used to enhance otherwise impaired speech signals observed using headsets, headphones, and earphones, as more fully described below in several exemplary embodiments.

The statistics, frequency bands, and/or threshold values indicative of a presence or an absence of speech can vary among different audio-appliance configurations. Nonetheless, it is surmised that other acoustic appliances exhibit repeatable, consistent sound-pressure level (SPL) and/or sound power differences over other (e.g., similar or different) frequency bands. Accordingly, similar statistics can be obtained from other acoustic appliances having, for example, different combinations of microphones and/or beamformers.

III. Multi-Channel Voice-Activity Detection: Example 1

Figure 12:
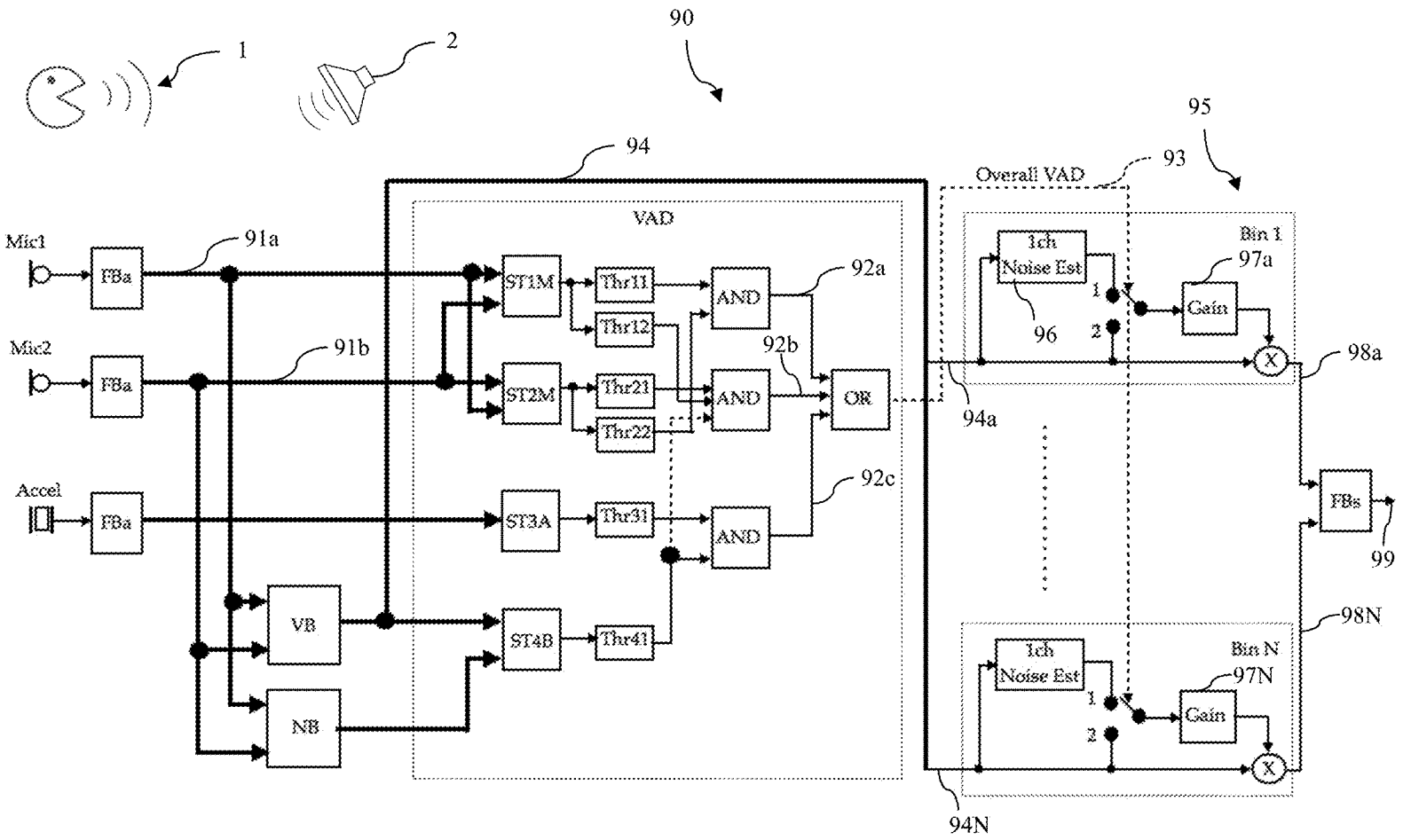
FIG. 12 schematically illustrates an example of a speech enhancer for an audio appliance.

Turning now to FIG. 12, a first example 90 of a speech enhancer is described. The first example 90 incorporates each of the four statistics identified above to assess whether a user's speech 1 is present and to determine an appropriate spectral gain to apply to an observed or derived signal to suppress impairments 2 such as, for example, ambient noise and/or other distractors coming from the directions of the noise beam nulls.

The four statistics (ST1M, ST2M, ST3A and ST4B, as described above in the foregoing Section II) in this example are derived from five channels provided by a headset as in the style of an earphone 10 shown in FIG. 1. The first microphone (Mic1), a second microphone (Mic2), an accelerometer (Accel), a voice beam (VB) and a noise beam (NB). The acoustic signal from each of the first microphone and the second microphone, as well as the signal from the accelerometer, can be transformed from a time-domain to a frequency-domain by the FBa (Filter Bank Analysis) modules. Beamformers can combine the frequency-domain representations of the acoustic signals 91*a*, 91*b* to define a corresponding voice beam (VB) and a corresponding noise beam (NB). Each signal on the five channels (Mic1, Mic2, Accel, VB, and NB) can pass to an overall voice-activity detector (VAD).

The four statistics can be determined in the VAD and compared to one or more selected threshold values (Thr11, Thr12, Thr21, Thr22, Thr31, Thr41) to provide respective indicia 92*a*, 92*b*, 92*c* of voice activity.

For example, each statistic can be compared with a corresponding threshold to define a respective voice-activity cue. In turn, each resulting voice-activity cue (e.g., a logical value of TRUE or FALSE) can be combined with one or more other voice-activity cues to provide respective indicia of voice-activity.

The threshold values, which may correspond uniquely to a given configuration of an audio appliance, can be stored in a look-up table or any other desired form. The indicia 92*a*, 92*b*, 92*c* can be combined, in this instance by a Boolean OR, to generate an overall voice-activity output 93. The output 93 from the VAD can be used to select an appropriate approach for computing noise-power, and thus gain, for each frequency bin in the voice beam (VB). For example, an estimated noise power in each frequency bin 94*a*-94N can be used to derive a gain 97*a*-97N between 0 and 1 to apply to the respective frequency bin to suppress ambient noises, distractors, or other impairments. Those of ordinary skill in the art will appreciate that several approaches can be used to determine such gains from estimated noise. For example, as described above, during an absence of speech, all signal content can be assumed to be noise, and the spectral gain can be used to remove the corresponding noise during times where speech is determined not to be present.

The VAD in FIG. 12 combines the several voice-activity cues using Boolean operators to derive four voice-activity indicators (a), (b), (c), and (d), as follows:

(a) [(ST1M>Thr11) AND (ST2M>Thr22)]

(b) [(ST2M>Thr21) AND (ST1M>Thr12)]

(c) [(ST3A>Thr31) AND (ST4B>Thr41)]

(d) (a) OR (b) OR (c)

The first VAD indicator, (a) suggests a presence of a user's speech (e.g., voiced speech) coming from a front proximity of the headset. It is conditioned/gated by values in ST2M being above a threshold Thr22.

The second VAD indicator (b) indicates a presence of the user's speech (e.g., unvoiced speech) coming from the front proximity of the headset, and is conditioned/gated by values in ST1M being above a threshold Thr12. Optionally, the second VAD indicator (b) can be further conditioned/gated by the ST4B statistic being above a selected threshold Thr41 (e.g., [(ST2M>Thr21) AND (ST1M>Thr12) AND (ST4B>Thr41)].

The third VAD condition (c) indicates a presence of a vibration in the accelerometer, such as user's vocal cord vibrations during voiced speech. It is conditioned by values in ST4B above a threshold Thr41 so that possible motion/touch artifacts (e.g., vibrations other than speech) in the accelerometer are rejected.

VAD indicator (d) represents an overall determination 93 of voice-activity (Overall VAD) and combines the first three conditions, or voice-activity cues, using a logical OR. Overall VAD in this example indicates that a sound (voiced or unvoiced) is coming from a front proximity of the headset concurrently with vibration in the accelerometer, such as when the user is speaking. This Overall VAD signal 93 can be used in the noise suppression module 95 for each frequency bin to switch between, for example, a stationary noise-power estimate 96 (or other suitable noise-power estimate) and a power (stationary or nonstationary) in each frequency bin 94*a*-94N in the voice beam signal.

For each time frame that the Overall VAD signal 93 equals "1" (indicating a presence of speech), the noise power estimate in each frequency bin can be equal to, for example, a one-channel noise-power estimate 96. An example of a suitable one-channel noise-power estimate is minimum tracking (Ephraim and Malah, 1985). Those of ordinary skill in the art will appreciate that other, e.g., more complex, methods can be used to estimate the noise power when the Overall VAD indicates a presence of user speech (e.g., is equal to "1"). For example, when the Overall VAD=1 the noise estimation can be a measure of the second audio signal from which a scaled difference between the first and second audio signals has been subtracted. Other similar methods can be employed that allow estimation of both stationary and nonstationary noises during the presence of user speech.

When Overall VAD=0 (e.g., the Overall VAD determines an absence of speech) the noise power estimate in each frequency bin, for this example, can be assumed to be equal to the power (stationary or nonstationary) in the voice beam signal 94 in that frequency bin 94*a*-94N.

Once the noise power estimate is computed in each frequency bin 94*a*-94N, a gain 97*a*-97N between 0 and 1 can be computed in correspondence with the noise power estimate using, for example, an Ephrain-Malah technique, Wienner filtering, and/or other techniques. The gain 97*a*-97N can be multiplied by the voice beam signal in each bin 94*a*-94N, and the scaled bin signals 98*a*-98N can be synthesized into a gain-adjusted output signal 99. The synthesis is depicted in FIG. 12 by the Filter Bank Synthesis (FBs) module that generates the output signal 99.

The gain-adjusted output signal 99 can be further processed by other, e.g., time-domain modules such as Equalizer (EQ), Automatic Gain Control (AGC), and Soft Clipper (SC) and can be output from the audio appliance by a selected output device. In a working version of this example, impairments from background music originating generally from a direction of a user's mouth were suppressed by between about 3 dB and about 20 dB, such as, for example, between about 7 dB and about 18 dB, with between about 10 dB and about 15 dB being one particular exemplary range, compared to a level of suppression provided by spectral separation between the voice beam and the noise beam (e.g., FIG. 5) alone.

IV. Multi-Channel Voice-Activity Detection: Example 2

Figure 13:
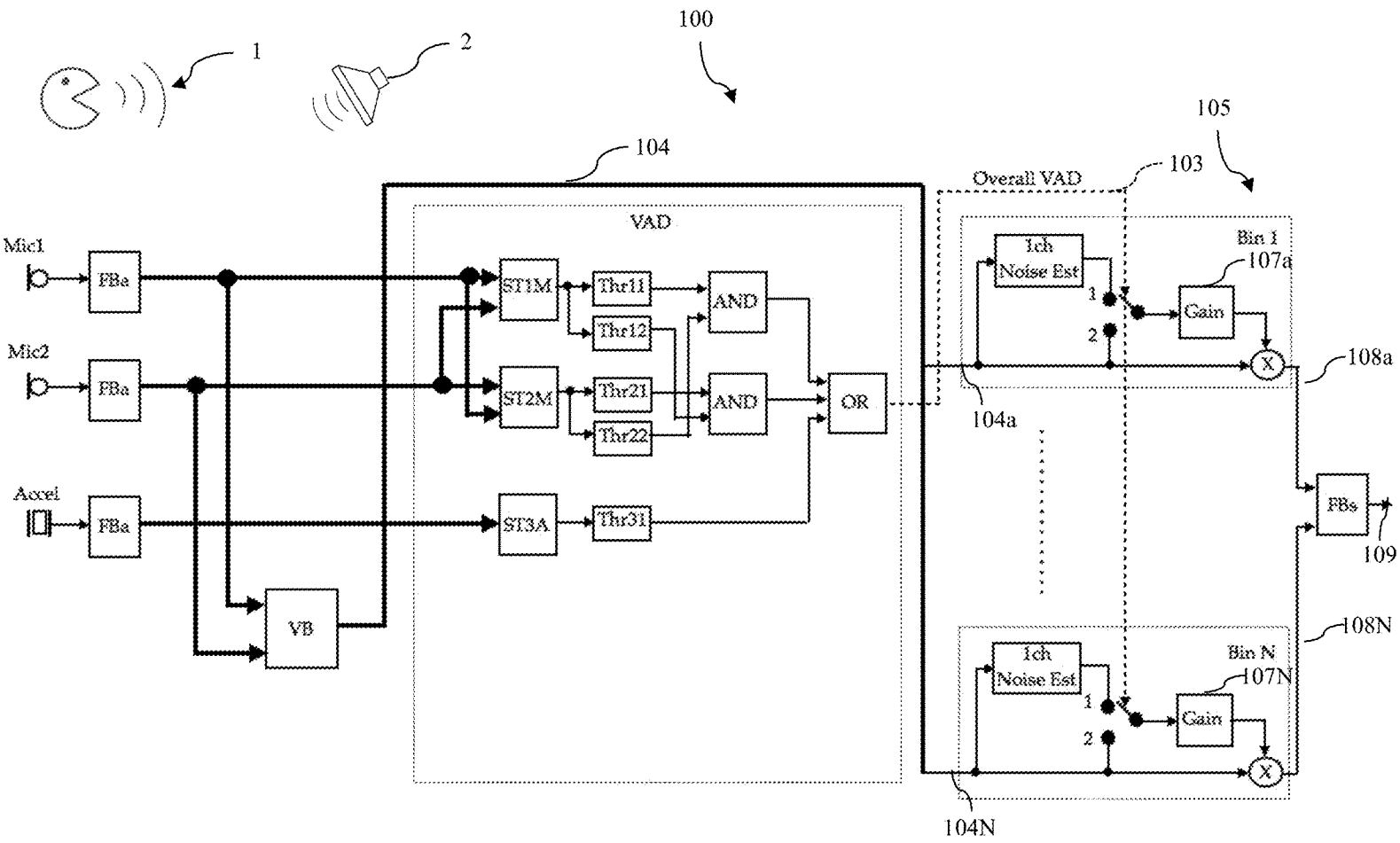
FIG. 13 schematically illustrates another example of a speech enhancer for an audio appliance.

In FIG. 13, the speech enhancer 100 uses four channels (Mic1, Mic2, Accel, and VB) for noise-suppression to derive three statistics (ST1M, ST2M, and ST3A) for voice-activity detection. The speech-enhancer 100 in FIG. 13 is similar to that shown and described in relation to FIG. 12, except in FIG. 13 the noise beam is omitted, and thus the fourth statistic ST4B also is omitted from the enhancer 100.

As with the system shown in FIG. 12, the three statistics are computed across relatively wide frequency bands (e.g., wider than an individual frequency bin) and are compared with selected thresholds to obtain independent voice-activity cues:

(a) [(ST1M>Thr11) AND (ST2M>Thr22)]
(b) [(ST2M>Thr21) AND (ST1M>Thr12)]
(c) [(ST3A>Thr31)]
(d) (a) OR (b) OR (c)

An output 103 from the Overall VAD (d) corresponds to whether any of the first three voice-activity cues indicates a presence of user's speech, e.g., whether voiced or unvoiced sound arises from a front proximity of the headset, or voiced sound excites the accelerometer, such as when a user is speaking.

As in the first example, the Overall VAD signal 103 can be used by the noise suppressor 105 to select an appropriate noise-estimation model from which to compute a gain 107*a*-107N to apply to each bin 104*a*-104N of the voice beam (VB). As in the first example, the bin signals 108*a*-108N from the noise suppressor 105 can be synthesized to provide a gain-adjusted output 109. The gain-adjusted output signal 109 can be further processed by other, e.g., time-domain modules such as Equalizer (EQ), Automatic Gain Control (AGC), and Soft Clipper (SC) and can be output by a selected output device.

V. Multi-Channel Voice-Activity Detection: Example 3

Figure 14:
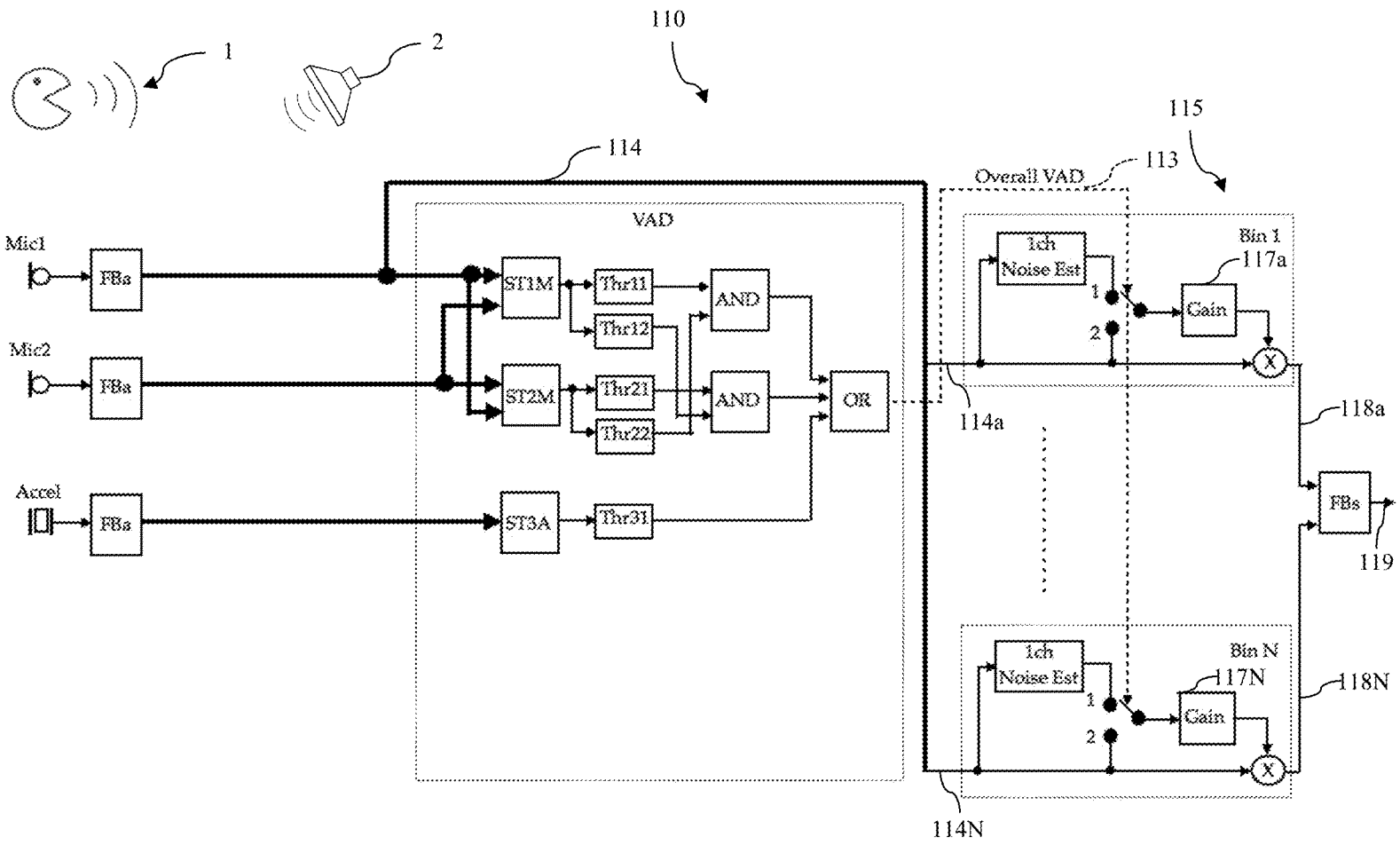
FIG. 14 schematically illustrates a third example of a speech enhancer for an audio appliance.

In FIG. 14, the speech enhancer 110 uses three channels (Mic1, Mic2, Accel) to suppress noise and to derive three statistics (ST1M, ST2M, and ST3A) for voice-activity detection. The noise suppressor 115 in FIG. 14 is similar to that shown and described in relation to FIGS. 12 and 13, except in FIG. 14, the voice beam (VB) and the noise beam (NB) are omitted, and thus the fourth statistic ST4B also is omitted from FIG. 14. Further, the acoustic signal 114 from the first microphone (Mic1) is gain adjusted in each frequency bin 114*a*-114N by the noise suppressor 115, rather than the voice beam as in FIGS. 12 and 13.

As with the system shown in FIGS. 12 and 13, the three statistics in this example are computed across relatively wide frequency bands (e.g., wider than an individual frequency bin) and are compared with selected thresholds to obtain independent voice-activity cues:

(a) [(ST1M>Thr11) AND (ST2M>Thr22)]
(b) [(ST2M>Thr21) AND (ST1M>Thr12)]
(c) [(ST3A>Thr31)]
(d) (a) OR (b) OR (c)

As in the first example, the Overall VAD signal 113 can be used by the noise suppressor 115 to select an appropriate noise-estimation model from which to compute a gain 117*a*-117N. However, in the third example, rather than to apply the gain 117*a*-117N to each bin of the voice beam (VB), the gain is applied to each bin 114*a*-114N in the Mic1 signal. Thus, for each time frame when the Overall VAD=1 the noise power estimate in each frequency bin is equal to a selected one-channel noise estimate, that estimate is used to compute a gain 117*a*-117N by which to adjust the corresponding bin 114*a*-114N in the Mic1 signal. When Overall VAD=0 the noise power estimate in each frequency bin is equal to the power in the Mic1 signal in that frequency bin.

The resulting bin signals 118*a*-118N can then be synthesized by the FBs module to provide a gain-adjusted output signal 119. The gain-adjusted output signal 119 can be further processed by other, e.g., time-domain modules such as Equalizer (EQ), Automatic Gain Control (AGC), and Soft Clipper (SC) and can be output by a selected output device.

VI. Multi-Channel Voice-Activity Detection: Example 4

In yet another example of a speech enhancer, the accelerometer signal and the corresponding statistic ST3A can be omitted. In such an example, the speech enhancer could resemble the enhancer shown and described in relation to any of FIGS. 12, 13, and 14, subject to omission of the accelerometer and the third voice-activity cue (c).

VII. Computing Environments

Figure 15:
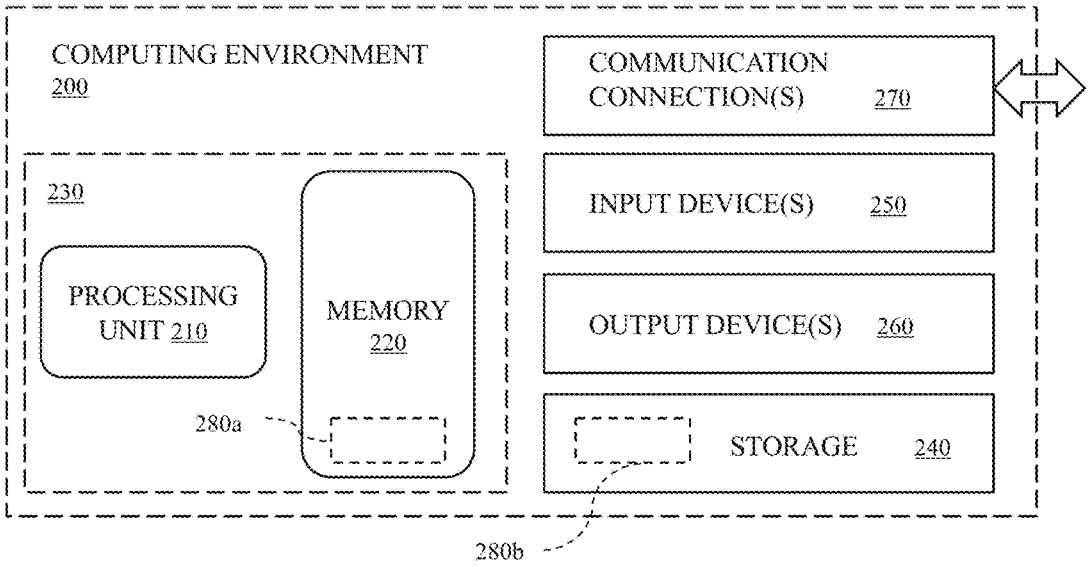
FIG. 15 shows a block diagram of a computing environment suitable for implementing disclosed methods.

FIG. 15 illustrates a generalized example of a suitable computing environment 200 in which described methods, embodiments, techniques, and technologies relating, for example, to speech enhancement can be implemented. The computing environment 200 is not intended to suggest any limitation as to scope of use or functionality of the technologies disclosed herein, as each technology may be implemented in diverse general-purpose or special-purpose computing environments. For example, each disclosed technology may be implemented with other computer system configurations, including wearable and/or handheld devices (e.g., a mobile-communications device, and more particularly but not exclusively, IPHONE®/IPAD®/AIRPODS®/HOMEPOD™ devices, available from Apple Inc. of Cupertino, Calif.), multiprocessor systems, microprocessor-based or programmable consumer electronics, embedded platforms, network computers, minicomputers, mainframe computers, smartphones, tablet computers, data centers, audio appliances, and the like. Each disclosed technology may also be practiced in distributed computing environments where tasks are performed by remote processing devices that are linked through a communications connection or network. In a distributed computing environment, program modules may be located in both local and remote memory storage devices.

The computing environment 200 includes at least one central processing unit 210 and a memory 220. In FIG. 15, this most basic configuration 230 is included within a dashed line. The central processing unit 210 executes computer-executable instructions and may be a real or a virtual processor. In a multi-processing system, or in a multi-core central processing unit, multiple processing units execute computer-executable instructions (e.g., threads) to increase processing speed and as such, multiple processors can run simultaneously, despite the processing unit 210 being represented by a single functional block.

A processing unit can include an application specific integrated circuit (ASIC), a general purpose microprocessor, a field-programmable gate array (FPGA), a digital signal controller, or a set of hardware logic structures (e.g., filters, arithmetic logic units, and dedicated state machines) arranged to process instructions.

The memory 220 may be volatile memory (e.g., registers, cache, RAM), non-volatile memory (e.g., ROM, EEPROM, flash memory, etc.), or some combination of the two. The memory 220 stores software 280*a* that can, for example, implement one or more of the technologies described herein, when executed by a processor. Disclosed speech enhancers can be embodied in software, firmware or hardware (e.g., an ASIC).

A computing environment may have additional features. For example, the computing environment 200 includes storage 240, one or more input devices 250, one or more output devices 260, and one or more communication connections 270. An interconnection mechanism (not shown) such as a bus, a controller, or a network, interconnects the components of the computing environment 200. Typically, operating system software (not shown) provides an operating environment for other software executing in the computing environment 200, and coordinates activities of the components of the computing environment 200.

The store 240 may be removable or non-removable, and can include selected forms of machine-readable media. In general machine-readable media includes magnetic disks, magnetic tapes or cassettes, non-volatile solid-state memory, CD-ROMs, CD-RWs, DVDs, magnetic tape, optical data storage devices, and carrier waves, or any other machine-readable medium which can be used to store information and which can be accessed within the computing environment 200. The storage 240 can store instructions for the software 280*b*, which can implement technologies described herein.

The store 240 can also be distributed over a network so that software instructions are stored and executed in a distributed fashion. In other embodiments, some of these operations might be performed by specific hardware components that contain hardwired logic. Those operations might alternatively be performed by any combination of programmed data processing components and fixed hardwired circuit components.

The input device(s) 250 may be any one or more of the following: a touch input device, such as a keyboard, keypad, mouse, pen, touchscreen, touch pad, or trackball; a voice input device, such as a microphone transducer, speech-recognition software and processors; a scanning device; or another device, that provides input to the computing environment 200. For audio, the input device(s) 250 may include a microphone or other transducer (e.g., a sound card or similar device that accepts audio input in analog or digital form), or a computer-readable media reader that provides audio samples to the computing environment 200.

The output device(s) 260 may be any one or more of a display, printer, loudspeaker transducer, DVD-writer, or another device that provides output from the computing environment 200. An output device can include or be embodied as a communication connection 270.

The communication connection(s) 270 enable communication over or through a communication medium (e.g., a connecting network) to another computing entity. A communication connection can include a transmitter and a receiver suitable for communicating over a local area network (LAN), a wide area network (WAN) connection, or both. LAN and WAN connections can be facilitated by a wired connection or a wireless connection. If a LAN or a WAN connection is wireless, the communication connection can include one or more antennas or antenna arrays. The communication medium conveys information such as computer-executable instructions, compressed graphics information, processed signal information (including processed audio signals), or other data in a modulated data signal. Examples of communication media for so-called wired connections include fiber-optic cables and copper wires. Communication media for wireless communications can include electromagnetic radiation within one or more selected frequency bands.

Machine-readable media are any available media that can be accessed within a computing environment 200. By way of example, and not limitation, with the computing environment 200, machine-readable media include memory 220, storage 240, communication media (not shown), and combinations of any of the above. Tangible machine-readable (or computer-readable) media exclude transitory signals.

As explained above, some disclosed principles can be embodied in a tangible, non-transitory machine-readable medium (such as microelectronic memory) having stored thereon instructions. The instructions can program one or more data processing components (generically referred to here as a "processor") to perform a processing operations described above, including estimating, computing, calculating, measuring, adjusting, sensing, measuring, filtering, addition, subtraction, inversion, comparisons, and decision making. In other embodiments, some of these operations (of a machine process) might be performed by specific electronic hardware components that contain hardwired logic (e.g., dedicated digital filter blocks). Those operations might alternatively be performed by any combination of programmed data processing components and fixed hardwired circuit components.

VII. Other Embodiments

The examples described above generally concern apparatus, methods, and related systems to enhance observed speech using a variety of forms of audio appliance.

The previous description is provided to enable a person skilled in the art to make or use the disclosed principles. Embodiments other than those described above in detail are contemplated based on the principles disclosed herein, together with any attendant changes in configurations of the respective apparatus described herein, without departing from the spirit or scope of this disclosure. Various modifications to the examples described herein will be readily apparent to those skilled in the art.

For example, the detailed examples described above rely on transducers within a single audio appliance (e.g., an earphone). Nonetheless, earphones often are donned and used in pairs, e.g., one earphone for each ear of a user. Consequently, disclosed principles can be applied to each earphone in the pair. Similarly, disclosed speech-enhancement principles can be expanded incorporate transducer outputs from a second earphone (e.g., from the second earphone's microphone(s), accelerometers, etc.)

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of systems to enhance speech. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features claimed herein. Accordingly, this detailed description shall not be construed in a limiting sense, and following a review of this disclosure, those of ordinary skill in the art will appreciate the wide variety of speech enhancement techniques that can be devised using the various concepts described herein.

Moreover, nothing disclosed herein is intended to be dedicated to the public regardless of whether such disclosure is explicitly recited in the claims. No claim feature is to be construed under the provisions of 35 USC 112(f), unless the feature is expressly recited using the phrase "means for" or "step for".

The appended claims are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". Further, in view of the many possible embodiments to which the disclosed principles can be applied, I reserve to the right to claim any and all combinations of features and technologies described herein as understood by a person of ordinary skill in the art, including, for example, all that comes within the scope and spirit of the following claims.

I currently claim:

1. An audio appliance, comprising:

a first microphone transducer to provide a first acoustic signal;

a second microphone transducer to provide a second acoustic signal, wherein the first microphone transducer and the second microphone transducer are spaced apart from each other and define a longitudinal axis;

a voice-activity detector configured to determine a presence or an absence of user speech responsive to a combination of voice-activity cues comprising, a first level difference between the first acoustic signal and the second acoustic signal within a first frequency band, and a second level difference between the first acoustic signal and the second acoustic signal within a second frequency band; and a noise suppressor configured, responsive to a determined presence of speech by the voice-activity detector, to suppress in a noise-supressed output-signal impairments originating from a direction of up to about 75-degrees from the longitudinal axis by between about 3 dB and about 20 dB; and an output device to output the noise-suppressed output-signal.

2. An audio appliance according to claim 1, wherein the combination of voice-activity cues further comprises a comparison of the first level difference to a first threshold and a comparison of the second level difference to a second threshold, wherein the voice-activity detector is to determine a presence of user speech responsive to the first level difference exceeding the first threshold and the second level difference exceeding the second threshold.

3. An audio appliance according to claim 2, wherein the comparison of the first level difference to the first threshold and the comparison of the second level difference to the second threshold comprises a first voice-activity cue, wherein the combination of voice-activity cues further comprises a second voice-activity cue comprising a comparison of the second level difference to a third threshold and a comparison of the first level difference to a fourth threshold.

4. An audio appliance according to claim 3, wherein the voice-activity detector determines a presence of user speech responsive to the second level difference exceeding the third threshold and the first level difference exceeding the fourth threshold.

5. An audio appliance according to claim 3, wherein the combination of voice-activity cues further comprises a level difference between a first beam-formed combination of the first acoustic signal with the second acoustic signal and a second beam-formed combination of the first acoustic signal with the second acoustic signal.

6. An audio appliance according to claim 5, wherein the voice-activity detector determines a presence of user speech responsive to the second level difference exceeding the third threshold, the first level difference exceeding the fourth threshold, and the level difference between the first beam-formed combination and the second beam-formed combination exceeding a fifth corresponding threshold level difference.

7. An audio appliance according to claim 2, wherein the comparison of the first level difference to the first threshold and the comparison of the second level difference to the second threshold comprises a first voice-activity cue, wherein the combination of voice-activity cues further comprises a second voice-activity cue comprising a comparison of an output from an accelerometer within a third frequency band to a third threshold, the second voice-activity cue further comprising a comparison of a fourth threshold to a level difference between a first beam-formed combination of the first acoustic signal with the second acoustic signal and a second beam-formed combination of the first acoustic signal with the second acoustic signal.

8. An audio appliance according to claim 1, wherein the combination of voice-activity cues further comprises a level of a first beam-formed combination of the first acoustic signal and the second acoustic signal within a third frequency band, a level of a second beam-formed combination of the first acoustic signal and the second acoustic signal within the third frequency band, a level difference between the first beam-formed combination and the second beam-formed combination within the third frequency band, or a combination thereof.

9. An audio appliance according to claim 1, further comprising an accelerometer, wherein the combination of voice-activity cues comprises an output from the accelerometer within a third frequency band.

10. An audio appliance according to claim 1, wherein the noise-suppressed output-signal comprises a synthesis of a plurality of gain-adjusted frequency bins of the first acoustic signal, the second acoustic signal, or a selected beam-formed combination of the first acoustic signal with the second acoustic signal, wherein each gain-adjusted frequency bin corresponds to a respective gain determined responsive to an estimate of noise-power in the respective frequency bin, and wherein the estimate of noise-power in the respective bin corresponds to the determined presence or absence of speech by the voice-activity detector.

11. An audio appliance comprising a first microphone transducer, a second microphone transducer, wherein the first microphone transducer and the second microphone transducer are spaced apart from each other to define a longitudinal axis, an output device, a processor, and a memory, wherein the memory contains instructions that, when executed by the processor, cause the audio appliance to receive a first audio signal from the first microphone transducer and to receive a second audio signal from the second microphone transducer;

to determine a presence or an absence of speech responsive to a combination of voice-activity cues comprising a first level difference between the first acoustic signal and the second acoustic signal within a first frequency band and a second level difference between the first acoustic signal and the second acoustic signal within a second frequency band;

responsive to the determined presence of speech, to generate a noise-suppressed output-signal having between about 3 dB and about 20 dB attenuation to impairments originating from a direction of up to about 75-degrees from the longitudinal axis of the audio appliance; and with the output device, to output flail the noise-suppressed output-signal.

12. An audio appliance according to claim 11, wherein the combination of voice-activity cues further comprises a comparison of the first level difference to a first threshold and a comparison of the second level difference to a second threshold, wherein, when executed by the processor, the instructions further cause the audio appliance to determine a presence of speech responsive to the first level difference exceeding the first threshold and the second level difference exceeding the second threshold.

13. An audio appliance according to claim 11, wherein the combination of voice-activity cues further comprises a level of a first beam-formed combination of the first acoustic signal and the second acoustic signal within a third frequency band, a level of a second beam-formed combination of the first acoustic signal and the second acoustic signal within the third frequency band, a level difference between the first beam-formed combination and the second beam-formed combination, or a combination thereof.

14. An audio appliance according to claim 11, further comprising an accelerometer, wherein the combination of voice-activity cues comprises an output from the accelerometer within a third frequency band.

15. An audio appliance comprising a first microphone transducer, a second microphone transducer, an output device, a processor, and a memory, wherein the first transducer and the second transducer are spaced apart from each other to define a longitudinal axis, wherein the memory contains instructions that, when executed by the processor, cause the audio appliance to determine a presence of voice activity in an observed acoustic signal responsive to a combination of a first voice-activity cue corresponding to a first frequency band with a second voice-activity cue corresponding to a second frequency band;

responsive to a determined presence of voice activity in the observed acoustic signal, to suppress impairments originating from a direction of up to about 75-degrees from the longitudinal axis in the observed acoustic signal by between about 3 dB and about 20 dB compared to a level of the impairments in the observed acoustic signal; and to synthesize and to output a noise-suppressed output signal corresponding to the observed acoustic signal and the suppressed impairments.

16. An audio appliance according to claim 15, wherein the first voice-activity cue comprises a measure of a first voice-activity statistic corresponding to an output from the first microphone transducer and an output from the second microphone transducer.

17. An audio appliance according to claim 16, wherein the second voice-activity cue comprises a measure of a second voice-activity statistic corresponding to an output from the first microphone transducer and an output from the second microphone transducer.

18. An audio appliance according to claim 15, further comprising an accelerometer and/or a beam former to generate one or more beam-formed combinations of an output from the first microphone transducer with an output from the second microphone transducer.

19. An audio appliance according to claim 18, wherein the first voice-activity cue comprises a measure of an acoustic signal from the first microphone, a measure of an acoustic signal from the second microphone, a measure of an output from the accelerometer, and/or a measure of an output from the beam former.

* * * * *